US006742385B2

(12) United States Patent
Katayama

(10) Patent No.: US 6,742,385 B2
(45) Date of Patent: Jun. 1, 2004

(54) METHOD FOR SELECTING A GOLF BALL, AND METHOD AND SYSTEM FOR SELECTING A GOLF CLUB AND A GOLF BALL

(75) Inventor: Shu Katayama, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/121,701

(22) Filed: Apr. 15, 2002

(65) Prior Publication Data

US 2002/0152796 A1 Oct. 24, 2002

(30) Foreign Application Priority Data

Apr. 20, 2001 (JP) ..... 2001-123212

(51) Int. Cl.[7] ..... A63B 53/00
(52) U.S. Cl. ..... 73/65.03; 73/12.02
(58) Field of Search ..... 73/11.01, 12.01, 73/12.02, 65.03

(56) References Cited

U.S. PATENT DOCUMENTS 4,261,566 A * 4/1981 MacDougall ..... 473/289
4,375,887 A * 3/1983 Lynch et al. ..... 473/409
5,092,602 A * 3/1992 Witler et al. ..... 473/199
5,836,832 A * 11/1998 Boehm et al. ..... 473/354
6,014,887 A * 1/2000 Naruo et al. ..... 73/12.04
6,192,323 B1 * 2/2001 Boehm ..... 702/182
6,385,559 B2 * 5/2002 Boehm ..... 702/182

* cited by examiner

*Primary Examiner*—Max Noori
(74) *Attorney, Agent, or Firm*—Sughrue Mion, PLLC

(57) ABSTRACT

A method for selecting a golf ball suitable for a golfer, comprising the steps of (i) obtaining head speed and backspin when a golfer hits a golf ball with a golf club; (ii) obtaining from the golfer ball-type selection data for determining which among a plurality of ball types is suitable for the golfer; and (iii) selecting a golf ball of a type (e.g., a distance-type ball or a control-type ball) suitable for the golfer on the basis of the head speed and backspin obtained in step (i) and the ball-type selection data obtained in step (ii), in such a manner that the selected golf ball produces backspin close to optimal backspin corresponding to the above-described head speed.

10 Claims, 4 Drawing Sheets

METHOD FOR SELECTING A GOLF BALL, AND METHOD AND SYSTEM FOR SELECTING A GOLF CLUB AND A GOLF BALL

BACKGROUND OF THE INVENTION

1. Field of the Invention

The present invention relates to a method for selecting a golf ball suitable for a golfer, and to a method and system for selecting a golf club and a golf ball suitable for a golfer.

2. Description of the Related Art

Conventionally, when a golfer selects a suitable golf club and/or a suitable golf ball, he or she collects relevant catalogs and/or hits balls on a trial basis, and the golfer then selects a golf club and/or a golf ball on the basis of data of the catalogs and/or results of the trial hit. This is a general manner of selecting a golf club and/or a golf ball.

Further, in order to select a golf club suitable for a golfer, there has conventionally been used a method in which the golfer is requested to hit golf balls with various golf clubs; head speeds of the golf clubs at that time are measured; and a golf club suitable for the golfer is selected on the basis of the head speeds.

However, even when the former method of selecting a golf club or a golf ball is used, the golfer encounters difficulty in determining which golf club or golf ball is really suited for him or her, because the golfer can browse only a limited number of catalogs and the time for trial hitting is limited.

Moreover, the latter method is adapted to select a golf club on the basis of a head speed that a golfer can attain (hereinafter referred to as a "head speed of a golfer"), and the types of data used for selection are few. Therefore, in some cases the latter method fails to select a golf club suitable for the golfer.

SUMMARY OF THE INVENTION

The present invention has been accomplished in view of the foregoing, and an object of the present invention is to provide a method for properly selecting a golf ball suitable for a golfer, and a method and system for properly selecting a golf club and a golf ball suitable for a golfer.

To achieve the above object, the present inventors have carried out earnest studies and found that a golf ball suitable for a golfer can be properly selected through use of head speed of a golf club and hit-ball data, which are obtained when the golfer hits a golf ball with the golf club, and ball-type selection data for determining which among a plurality of ball types is suitable for the golfer.

Further, the present inventors have found that a golf club suitable for a golfer can be properly selected when the selection is performed in consideration of not only a head speed of a golfer but also hit-ball data of the golfer, such as initial speed, launch angle, backspin, and side spin of a hit ball; specifically, when actual hit data such as a head speed of a golfer is obtained, ideal hit-ball data of the golfer are calculated on the basis of the actual hit data, and a golf club which is suitable for realization of the ideal hit-ball data is selected.

The present invention has been accomplished on the basis of these findings. According to a first aspect, the present invention provides a method for selecting a golf ball suitable for a golfer, comprising the steps of:

(i) obtaining at least one of head speed and hit-ball data when a golfer hits a golf ball with a golf club;

(ii) obtaining, from the golfer, ball-type selection data for determining which among a plurality of ball types is suitable for the golfer; and (iii) selecting a golf ball of a type suitable for the golfer on the basis of the at least one of head speed and hit-ball data obtained in step (i) and the ball-type selection data obtained in step (ii).

According to a second aspect, the present invention provides a method for selecting a golf club and golf ball suitable for a golfer, comprising the steps of:

(a) obtaining at least one of head speed and hit-ball data when a golfer hits a golf ball with a golf club;

(b) obtaining ideal hit-ball data of the golfer on the basis of the at least one of head speed and hit-ball data obtained in step (a);

(c) selecting a golf club suitable for the golfer on the basis of the ideal hit-ball data obtained in step (b);

(d) obtaining at least one of head speed and hit-ball data when the golfer hits a golf ball with the golf club selected in step (c);

(e) obtaining, from the golfer, ball-type selection data for determining which among a plurality of ball types is suitable for the golfer; and (f) selecting a golf ball of a type suitable for the golfer, on the basis of the at least one of head speed and hit-ball data obtained in step (d) and the ball-type selection data obtained in step (e).

According to a third aspect, the present invention provides a system for selecting a golf club and golf ball suitable for a golfer, comprising:

actual hit data obtainment means for obtaining at least one of head speed and hit-ball data when a golfer hits a golf ball with a golf club; and ideal data obtainment means for obtaining ideal hit-ball data of the golfer on the basis of the at least one of head speed and hit-ball data obtained by the actual hit data obtainment means, wherein a golf club suitable for the golfer is selected on the basis of the ideal hit-ball data obtained by the ideal data obtainment means; and a golf ball of a type suitable for the golfer is selected on the basis of the at least one of head speed and hit-ball data, which are obtained by the actual hit data obtainment means as actual hit data when the golfer hits a golf ball by use of the selected golf club, and ball-type selection data obtained from the golfer and adapted for determining which among a plurality of ball types is suitable for the golfer.

The method for selecting a golf ball according to the present invention enables proper selection of a golf ball suitable for a golfer. Further, the method and system for selecting a golf club and a golf ball according to the present invention enables proper selection of a golf club and a golf ball suitable for a golfer.

DESCRIPTION OF THE INVENTION AND PREFERRED EMBODIMENT

Figure 1:
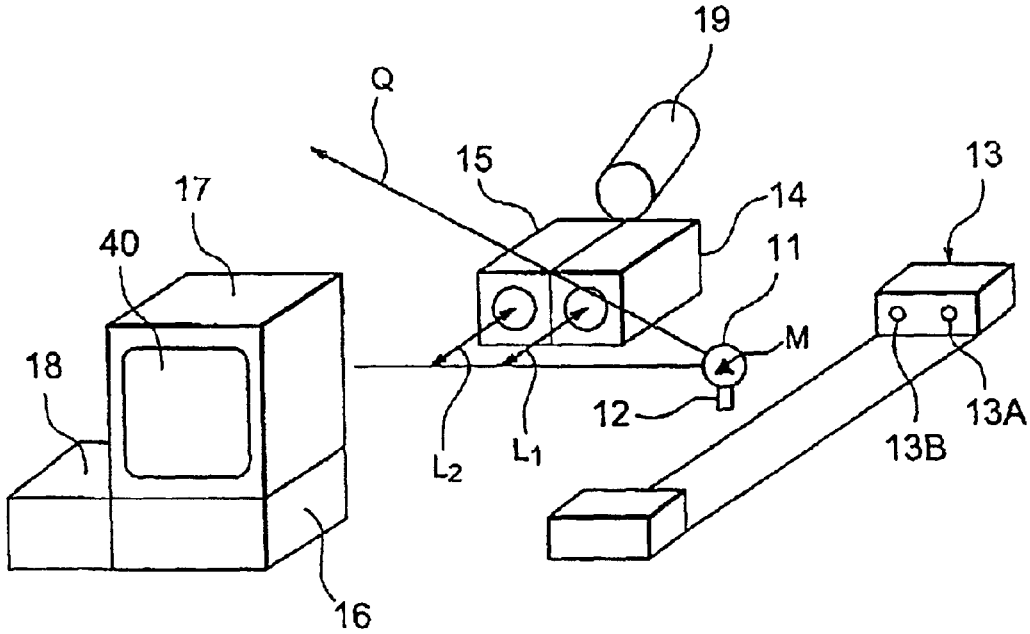
FIG. 1 is a schematic diagram of an embodiment of the system for selecting a golf club and a golf ball according to the present invention.

The present invention will now be described in further detail. In the method for selecting a golf ball according to the first aspect of the invention, at least one of head speed and hit-ball data is obtained when a golfer hits a golf ball with a golf club (step (i)). The term "hit-ball data" means various numerical data in relation to a golf ball at the time the golfer hits the golf ball. Examples of the hit-ball data include initial speed, launch angle, backspin, side spin of a hit ball, and travel distance calculated from a portion or the entirety of the data.

In this case, from the viewpoint of matching between a golf club and a golf ball, a golf club suitable for a golfer or a golf club which the golfer has used up to now is preferably used for selection of a golf ball. In particular, a golf club selected in step (c) is preferably used. In step (i), when the golfer hits a golf ball with a golf club, head speed and backspin of the hit golf ball are desirably obtained in order to achieve proper selection of a golf ball.

In the first aspect of the invention, ball-type selection data for determining which among a plurality of ball types is suitable for the golfer are obtained from the golfer (step (ii)). Examples of the plurality of types of golf balls include a distance-type ball, a semi-distance-type ball, a semi-spin-type ball, and a spin-type ball. The distance-type ball is designed so as to obtain high travel performance (travel distance) while limiting spin to a low or intermediate level. The spin-type ball is designed so as to impart spin of a high or intermediate level to thereby provide high spin performance (controllability). The semi-distance-type ball is designed to have characteristics between the distance-type ball and the spin-type ball and to provide intermediate travel performance (travel distance). The semi-spin-type ball is designed to have characteristics between the distance-type ball and the spin-type ball and to provide intermediate spin performance (controllability). The semi-distance-type ball and the semi-spin-type ball are designed to obtain travel performance and spin performance simultaneously.

In step (ii), at least one set of data selected from an average round score of the golfer, a handicap of the golfer, and a performance of the golf ball which the golfer requires is desirably obtained as the ball-type selection data. That is, when the golfer is recognized as an upper-level player on the basis of the average round score or handicap, a spin-type ball is determined to be suited for the golfer; when the golfer is recognized as a beginner, a distance-type ball is determined to be suited for the golfer; and when the golfer is recognized as an intermediate level player, a semi-distance-type ball or semi-spin-type ball is determined to be suited for the golfer. Further, when the golfer requires controllability as the main parameter of ball performance, a spin-type ball is determined to be suited for the golfer; and when the golfer requires travel distance as the main parameter of ball performance, a distance-type ball is determined to be suited for the golfer. When the golfer requires both travel distance and controllability as the main parameters of ball performance, a semi-distance-type ball or semi-spin-type ball is determined to be suited for the golfer.

In the first aspect of the present invention, a golf ball of a type suitable for the golfer is desirably selected on the basis of the at least one of head speed and hit-ball data obtained in step (i) and the ball-type selection data obtained in step (ii) (step (iii)). In this case, in step (iii), a golf ball of a type suitable for the golfer is desirably selected on the basis of the head speed and the backspin of the hit ball obtained in step (i) and the ball-type selection data obtained in step (ii); in particular, an average round score of the golfer, a handicap of the golfer, and a performance of the golf ball which the golfer requires, in such a manner that the selected golf ball produces backspin close to optimal backspin corresponding to the above-described head speed.

More specifically, when a spin-type ball has been determined to be suitable for the golfer on the basis of the ball-type selection data obtained in step (ii), a golf ball(s) of at least one spin type suitable for the golfer is selected which produces backspin close to optimal backspin corresponding to the above-described head speed. Further, when a distance-type ball has been determined to be suitable for the golfer on the basis of the ball-type selection data obtained in step (ii), there is(are) selected a golf ball(s) of at least one distant type suitable for the golfer which produces backspin close to optimal backspin corresponding to the above-described head speed.

In the method and system for selecting a golf club and a golf ball according to the second and third aspects of the invention, first, a golfer is requested to hit a golf ball with a golf club, and at least one of head speed and hit-ball data is obtained at that time (step (a)). As described above, the term "hit-ball data" means various numerical data in relation to a golf ball at the time the golfer hits the golf ball. Examples of the hit-ball data include initial speed, launch angle, backspin, side spin, and travel distance of a hit ball.

In step (a), at least one of head speed, initial speed, launch angle, backspin, side spin, and travel distance is selected as the above-described at least one of head speed and hit-ball data; preferably, all these values are obtained. When all values of the above-described items are obtained, numerous data regarding the golfer who has hit balls can be obtained. Notably, as shown in an embodiment to be described later, the above-described head speed, initial speed, launch angle, backspin, and side spin can be measured by use of a measurement apparatus; and the travel distance can be calculated from the initial speed, launch angle, backspin, and side spin.

A golf club which the golfer has used for play and which is therefore familiar to the player is preferably used as the golf club to be used by the golfer to hit a golf ball in step (a). This enables acquisition of proper head speed and hit-ball data, to thereby enable more proper selection of a golf club suitable for the golfer.

In the second and third aspects of the invention, ideal hit-ball data of the golfer are obtained on the basis of the at least one of head speed and hit-ball data, obtained in the above-described manner (step (b)). At least one of ideal initial speed, ideal launch angle, ideal backspin, ideal side spin, and ideal travel distance is selected as the ideal hit-ball data; preferably, all these values are obtained. When all values of the above-described items are obtained, many data useful for selection of a club can be obtained. The ideal hit-ball data can be obtained through calculation or can be set in advance. For example, the ideal initial speed, ideal launch angle, and ideal backspin can be obtained from a head speed at the time the golfer actually hits a golf ball, in accordance with predetermined calculation expression. Further, the ideal side spin may be set to zero. Further, the ideal travel distance can be calculated from the ideal initial speed, ideal launch angle, ideal backspin, and ideal side spin, in accordance with predetermined calculation expression.

In the second and third aspects of the invention, a golf club suitable for the golfer is selected on the basis of the ideal hit-ball data obtained in the above-described manner (step (c)). That is, one or more types of golf clubs which are suitable for realization of the ideal hit-ball data are selected. This selection may be performed manually by a person or performed automatically by club selection means for selecting a golf club suitable for the golfer on the basis of the ideal hit-ball data.

In the second and third aspects of the invention, at least one of head speed and hit-ball data obtained when the golfer hits a golf ball with the golf club selected in step (c) are employed. Subsequently, a golf ball of a type suitable for the golfer is selected in steps (i) to (iii). In the second and third aspects of the invention, since data are obtained by use of a selected golf club, a golf ball which well matches the selected golf club can be selected. The steps (i) to (iii) are the same as those described in relation to the first aspect of the invention, and therefore their descriptions are not repeated.

In the second and third aspects of the invention, since at least one of head speed and hit-ball data are obtained when the golfer hits a golf ball with a golf club selected in the above-described manner, the effect of the selected club can be checked. In this case, at least one of initial speed, launch angle, backspin, side spin, and travel distance is selected as the above-described hit-ball data; preferably, all these values are obtained. When all values of the above-described items are obtained, the effect of the selected golf club can be checked on the basis of numerous data.

In the second and third aspects of the invention, data regarding the specifications of a golf club with which the golfer hits a golf ball in step (a) are preferably obtained separately. Reference to the specification data enables further proper selection of a golf club suitable for the golfer. In this case, the specification data include the total length, balance, total weight, loft angle, face angle, and lie angle of a golf club.

The preferred modes according to the second and third aspects of the invention include a method for selecting a golf club and a golf ball according to mode 1 to be described below, and a system for selecting a golf club and a golf ball according to mode 2 to be described below.

Mode 1:

A method for selecting a golf club and golf ball suitable for a golfer, comprising the steps of:

(a) obtaining at least one of head speed and hit-ball data (preferably, head speed, initial speed, launch angle, backspin, side spin, and travel distance) when a golfer hits a golf ball with a golf club (preferably a golf club which the golfer has used up to now);

(b) obtaining ideal hit-ball data (preferably, initial speed, launch angle, backspin, side spin, and travel distance) of the golfer on the basis of the at least one of head speed and hit-ball data (e.g., head speed) obtained in step (a);

(c) selecting a golf club suitable for the golfer on the basis of the ideal hit-ball data obtained in step (b);

(d) obtaining head speed and backspin when the golfer hits a golf ball with the golf club selected in step (c);

(e) obtaining from the golfer at least one set of data selected from an average round score of the golfer, a handicap of the golfer, and a performance of the golf ball which the golfer requires, as ball-type selection data for determining whether a distance-type ball or a spin-type ball is suitable for the golfer;

(f) selecting a distance-type golf ball or spin-type golf ball suitable for the golfer, on the basis of the head speed and backspin obtained in step (d) and the ball-type selection data obtained in step (e), in such a manner that the selected golf ball produces backspin close to optimal backspin corresponding to the above-described head speed.

Mode 2:

A system for selecting a golf club and golf ball suitable for a golfer, comprising:

actual hit data obtainment means for obtaining at least one of head speed and hit-ball data preferably, head speed, initial speed, launch angle, backspin, side spin, and travel distance) when a golfer hits a golf ball with a golf club (preferably a golf club which the golfer has used up to now); and ideal data obtainment means for obtaining ideal hit-ball data (preferably, initial speed, launch angle, backspin, side spin, and travel distance) of the golfer on the basis of the at least one of head speed and hit-ball data (e.g., head speed) obtained by the actual hit data obtainment means, wherein a golf club suitable for the golfer is selected on the basis of the ideal hit-ball data obtained by the ideal data obtainment means; and a distance-type golf ball or spin-type golf ball suitable for the golfer is selected on the basis of at least one of the head speed or the backspin which is obtained by the actual hit data obtainment means as actual hit data when the golfer hits a golf ball by use of the selected golf club, and ball-type selection data obtained from the golfer, the ball-type selection data including at least one set of data selected from an average round score of the golfer, a handicap of the golfer, and a performance of the golf ball which the golfer requires and being adapted for determining whether a distance-type ball or a spin-type ball is suitable for the golfer, the selection being performed in such a manner that the selected golf ball produces backspin close to optimal backspin corresponding to the above-described head speed.

The system for selecting a golf club and golf ball suitable for a golfer according to the third aspect of the present invention preferably includes comment producing means for producing a comment for the golfer on the basis of the at least one of the head speed and hit-ball data obtained by the actual hit data obtainment means. The comment enables the golfer to clearly know his or her swing characteristic and the effect of the selected golf club.

The system for selecting a golf club and golf ball suitable for a golfer according the third aspect of the present invention preferably includes printing means for printing at least one selected from the head speed and hit-ball data obtained by the actual hit data obtainment means, ideal hit-ball data obtained by the ideal data obtainment means, the name of the selected golf club, the name of the selected golf ball, and the comment produced by the comment producing means. This enables the golfer to easily know his or her swing characteristic and the effect of the selected golf club.

An embodiment of the present invention will now be described with reference to the drawings. FIG. 1 is a schematic diagram showing an embodiment of the system for selecting a golf club and a golf ball according to the third aspect of the present invention. The system includes golf ball setting means 12 for setting a golf ball 11 in place; specifically a tee for placing the golf ball 11 thereon, (hereinafter referred to as tee 12); sensor means 13 for detecting the passing (downswing) of a club head (not shown) for hitting the ball 11; a first camera 14 and a second camera 15; a control unit 16; a monitor 17; and a printer 18. The sensor means 13 is located behind the tee 12 with respect to the travel direction of the hit ball 11. The first camera 14 and the second camera 15 are disposed ahead of the tee 12 with respect to the travel direction of the ball 11 such that they are located a predetermined distance from the tee 12 and are apart from each other and face horizontally. The control unit 16 has trigger means for sending shutter signals for the hit ball 11 to the respective first and second cameras 14 and 15. When a detection signal is received from the sensor means 13, the trigger means sends shutter signals to the first and second cameras 14 and 15 at a proper timing such that an appropriate time lag is provided between the shutter signals sent to the first and second cameras 14 and 15. Reference letter M represents a mark printed on the surface of the ball 11. When measurement is performed by use of the present system, the ball 11 is set on the tee 12 in a state in which the mark M faces the side where the cameras 14 and 15 are present. The first and second cameras 14 and 15 are preferably CCD cameras each having a shutter speed of $1/10{,}000$ to $1/200{,}000$ second.

The sensor means 13 includes a pair of optical sensors, or a first sensor 13A and a second sensor 13B, each composed of a light-emitting element and a light-receiving element. The distance m2 between the tee 12 and the sensor means 13 is preferably approximately 40 mm. The distance m3 between the tee 12 and the first camera 14 and the distance m4 between the first and second cameras 14 and 15 preferably range from 50 to 300 mm and from 100 to 250 mm, respectively. The positional height of the first and second cameras 14 and 15 with respect to the golf ball 11 (placed on the tee 12) must be determined in consideration of the trajectory of the hit ball 11. For a certain site of measurement, a light 19 may be provided for illuminating the trajectory of the hit ball 11. Also, these cameras 14 and 15 may be equipped with respective strobes 20 (flashing means) which operate synchronously with shutters thereof. Each of the horizontal distances $L_1$ and $L_2$ between the hit ball 11 on its trajectory Q and the first and second cameras 14 and 15 is preferably 200 to 600 mm.

The control unit 16, which is connected to the sensor means 13, the cameras 14 and 15 equipped with the respective strobes 20, the monitor 17, and the printer 18 (specific connections are not illustrated), includes the following:

(1) Control Box

The control box includes the following:

a) Frame memory for recording photographed images b) Image analysis unit c) Timing control unit Sensor control, shutter control, I/O d) CPU unit e) FDD (floppy disk drive), HDD (hard disk drive), or flash memory (2) Software Software for performing the following functions:

a) Calculation and display of head speed, initial speed, launch angle (upward angle with respect to a horizontal line and sideward angle with respect to a reference line), backspin, and side spin b) Calculation of trajectory and travel distance c) Display of the following screens Divided screen (2 display areas for displaying the image of a ball and 1 display area for displaying measured values)

Launch angle distribution screen

Carry and/or total distance distribution screen

Trajectory screen d) Accumulation of data

Figure 2:
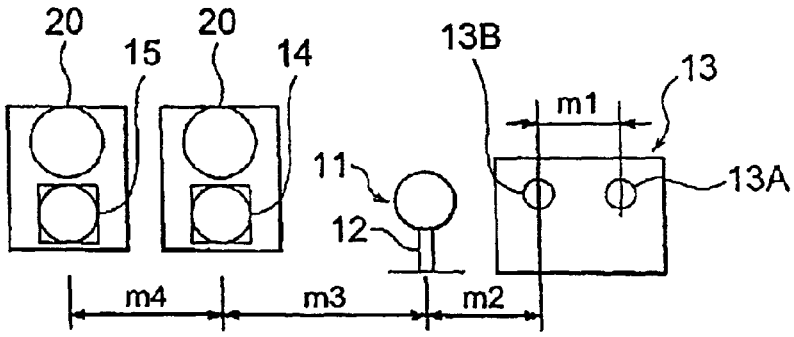
FIG. 2 is a view showing the arrangement of devices of the system of FIG. 1.
Figure 3:
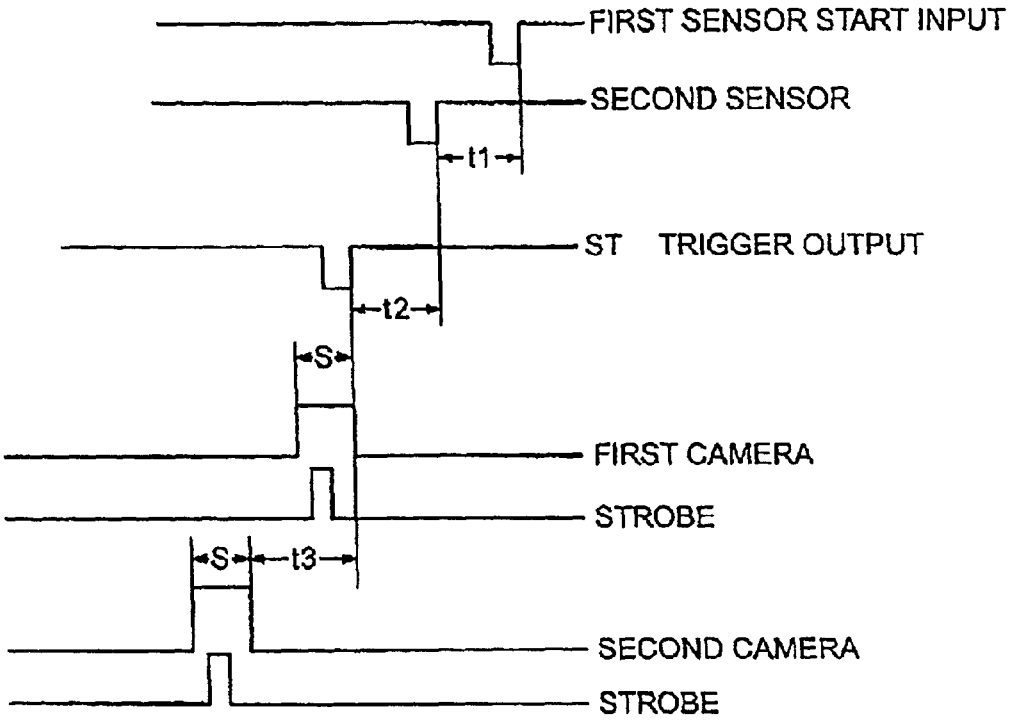
FIG. 3 is a timing chart illustrating operation of the system of FIG. 1.

Next, a method which the present system employs in order to measure head speed, initial speed, launch angle (upward angle with respect to a horizontal line), backspin, and side spin and to calculate travel distance will be described with reference to FIGS. 2 and 3. When the first and second sensors 13A and 13B detect the passage of a golf club head, the control unit 16 calculates time t1 required for a club head to pass between the sensors. Based on the measured time t1 and the distance between the sensors 13A and 13B, the control unit 16 calculates a head speed. Upon reception of a detection signal from the second sensor 13B, the control unit 16 outputs a trigger signal to each of the cameras 14 and 15 and to each of the strobes 20. In the present embodiment, a plurality of head speeds are previously measured. In operation, a delay time t2 and a shutter interval t3 are previously set in accordance with an applicable head speed selected from the previously measured head speeds. Further, an initial speed is measured from a time which the hit ball required to pass through the region between the two cameras 14 and 15 and the distance between the two cameras 14 and 15.

Figure 4:
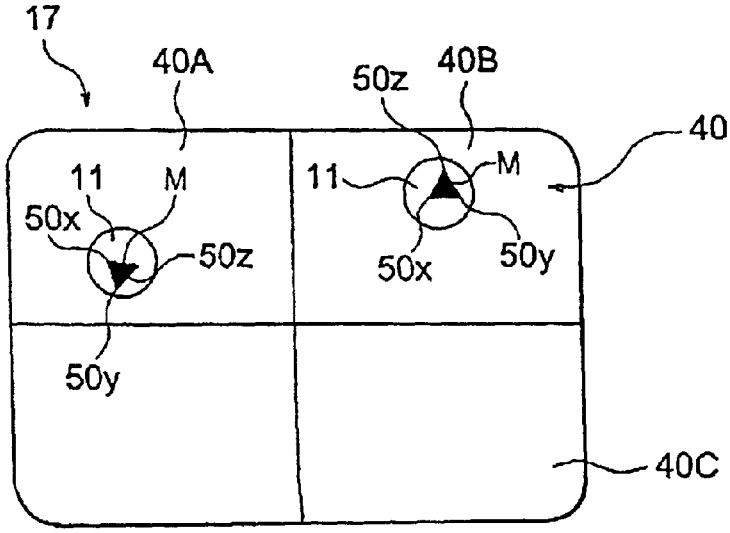
FIG. 4 is a view showing a monitor screen of the system of FIG. 1.

FIG. 4 shows the screen of the monitor 17 on which images of the hit ball are displayed. The monitor screen 40 is divided into four display areas. A first display area 40A displays the side view of the hit ball 11 as obtained through the first camera 14. A second display area 40B displays the side view of the hit ball 11 as obtained through the second camera 15. A third display area 40C displays measured values. In the present system, the mark M formed on the surface of the golf ball 11 assumes the form of an isosceles triangle. The mark M is colored black or similar dark color such that the mark M stands out against the color of the ball surface.

In the present system, with respect to images appearing in the first and second display areas 40A and 4013 (FIG. 4), outlines of the golf ball 11 displayed as a white portion are extracted from the black background by means of a binarizing method for digitizing the images into binary data (black/white); and speed and launch angle are obtained from the outlines. Subsequently, the mark M within each of the outlines of the golf ball 11 is extracted by means of a similar binarizing method.

After completion of the above-described processing, a main axis (a height-direction straight line bisecting the vertex angle) of the mark M is obtained; and the mark M is perpendicularly scanned from the main axis in order to obtain a change point at which the color changes from black to white. This scanning operation for searching a color-change point is performed along the main axis. As a result, lines respectively passing through two rows of change points; i.e., two sides, are obtained. Subsequently, base lines which perpendicularly intersect the median lines of the sides are set outside the black block (black mark); and scanning is performed from the base lines toward the block side in order to obtain the base. When the sides and the base are obtained, curve approximation is preferably employed in consideration of curvature of the spherical surface.

After a triangle; i.e., the mark M, is specified through the above-described image processing, three angular points 50*x*, 50*y*, and 50*z* are determined from the sides and the base.

Subsequently, the three-dimensional vectors of the three angular points 50$x$, 50$y$, and 50$z$ are obtained on the basis of the images appearing in the first and second display areas 40A and 40B, with the ball 11 being taken as a unit ball having a radius of 1. Based on the movement of the ball 11 from its position in the first display area 40A to that in the second display area 40B, the vector of the rotational axis of the ball 11 is obtained. Through vector analysis based on the thus-obtained three-dimensional vectors of the points and the thus-obtained vector of the rotational axis, the amount of rotation of the ball 11 is obtained. Based on the vector of the rotational axis and the thus-obtained amount of rotation, the amounts of backspin and side spin of the ball 11 can be obtained. Also, a difference in vertical position of the golf ball 11 between the first display area 40A and the second display area 40B (FIG. 4) is measured. Then, based on the thus-measured difference in vertical position and the distance m4 (horizontal distance), the upward launch angle of the ball 11 can be obtained. Further, a travel distance can be calculated from the thus-obtained initial speed, launch angle, backspin, and side spin.

In the present system, backspin and side spin are obtained automatically through image processing by use of the mark M of an isosceles triangle formed on the surface of the golf ball 11. However, backspin and side spin may be obtained in a similar manner by use of a character or a mark of another shape provided on the surface of a golf ball, or may be obtained through manual measurement (a method of manually plotting the mark while viewing displayed images).

Next, an example method of selecting a golf club and a golf ball by use of the present system will be described. In the system, the sensor means 13, the first camera 14, the second camera 15, the control unit 16, and the monitor 17 constitute actual hit data obtainment means; the control unit 16 and the monitor 17 constitute ideal data obtainment means; the control unit 16 constitutes comment producing means; and the control unit 16 and the printer 18 constitute printing means.

(1) First, a golfer hits a golf ball with a golf club which the golfer has used up to now and which is therefore familiar to the golfer. At this time, the actual hit data obtainment means obtains the head speed, initial speed, launch angle, backspin, side spin, and travel distance of the hit ball in the above-described manner. These values are displayed on the monitor 17. Each of these values may be an average value or a maximum value obtained through hitting of a plurality of balls.

(2) Subsequently, the ideal data obtainment means obtains an ideal initial speed, launch angle, backspin, side spin, and travel distance of the golfer on the basis of the head speed obtained by the actual hit data obtainment means. Specifically, the calculation unit 16 calculates the ideal initial speed, launch angle, and backspin from the head speed in accordance with the following expressions. The ideal side spin is set zero. The ideal travel distance is calculated from the ideal initial speed, launch angle, backspin, and side spin in accordance with a predetermined expression. These values are displayed on the monitor 17.

$$\text{Ideal initial speed} = F \times \text{head speed}$$

F: predetermined coefficient
(e.g., a predetermined value between 1.3 and 1.5)

$$\text{Ideal launch angle} = H \times \text{head speed} + I$$

H: predetermined coefficient
(e.g., a predetermined value between −0.4 and −0.2)

I: predetermined constant
(e.g., a predetermined value between 25 and 31)

$$\text{Ideal backspin} = J \times \text{head speed} + K$$

J: predetermined coefficient
(e.g., a predetermined value between −50 and −30)

K: predetermined constant
(e.g., a predetermined value between 3700 and 5100)

(3) A golf club suitable for the golfer is selected on the basis of the ideal hit-ball data obtained by the ideal data obtainment means. In this case, one or more clubs which are suitable for realization of the ideal hit-ball data may be selected on the basis of human judgment.

(4) In a manner similar to that used in (1) above, the actual hit data obtainment means obtains the head speed, initial speed, launch angle, backspin, side spin, and travel distance when the golfer hits a golf ball with the selected golf club. When two or more golf clubs are selected, the above-described values are obtained for each golf club. These values are displayed on the monitor 17. Each of these values may be an average value or a maximum value obtained through hitting of a plurality of balls.

(5) From the golfer, at least one set of data selected from an average round score of the golfer, a handicap of the golfer, and a main parameter of performance of the golf ball which the golfer requires are obtained as ball-type selection data for determining whether a distance-type ball or a spin-type ball is suitable for the golfer. Such data can be obtained by requesting the golfer to answer the following questionnaire. This questionnaire can be administered at any time.

Questionnaire:

(a) Level A: Your average round score?
(1) Lower than 86 (2) 86–105 (3) Higher than 105

(b) Level B: Your handicap?
(1) Lower than 13 (2) 13–32 (3) Higher than 32

(c) Request: Ball performance that you require?
(1) Controllability (2) Both travel distance and controllability (3) Travel distance When the golfer selects (1) in question (a) and/or question (b), the golfer is an upper-level player. In such a case, a spin-type ball is determined to be suited for the golfer. When the golfer selects (2) or (3) in question (a) and/or question (b), the golfer is a beginner or intermediate-level player. In such a case, a distance-type ball is determined to be suited for the golfer. When the golfer selects (1) in question (c), a spin-type ball is determined to be suited for the golfer; and when the golfer selects (2) or (3) in question (c), a distance-type ball is determined to be suited for the golfer. Notably, one or two of the questions (a) to (c) may be posed selectively, or all the questions (a) to (c) may be posed.

(6) A distance-type golf ball or spin-type golf ball suitable for the golfer is selected on the basis of the head speed and backspin obtained in (4) above and the ball-type selection data obtained in (5). The above selection is made in such a manner that the selected golf ball produces backspin close to optimal backspin corresponding to the head speed obtained in (4) above. The optimal backspin can be obtained by the following expression as in the case of the above-described ideal backspin. Notably, when the above-described values are obtained for two or more golf clubs in (4) above, values of a firstly recommended club are used.

$$\text{Optimal backspin} = J \times \text{head speed} + K$$

J: predetermined coefficient
(e.g., a predetermined value between −50 and −30)

K: predetermined constant (e.g., a predetermined value between 3700 and 5100)

Figure 5:
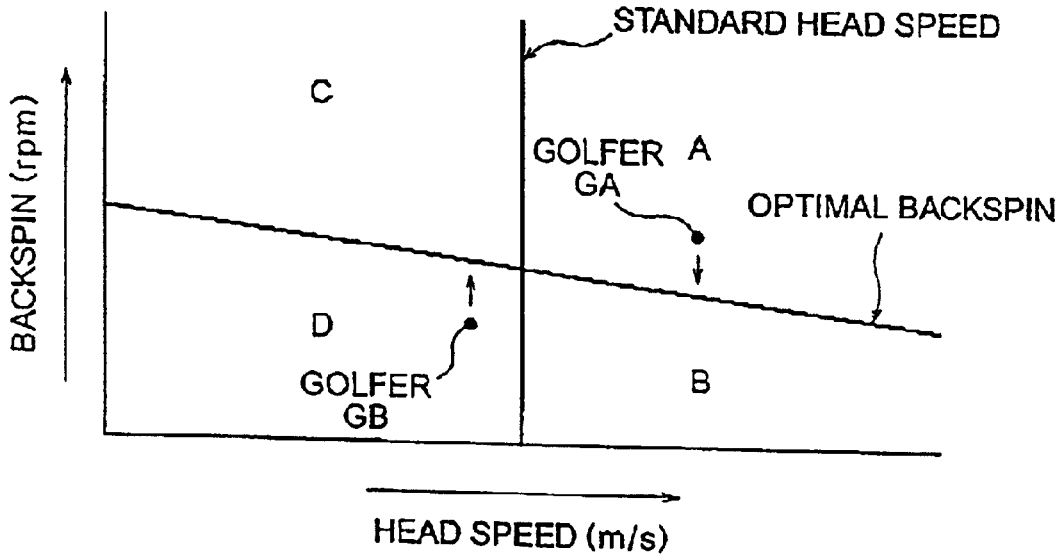
FIG. 5 is a graph representing the relation between backspin and head speed and divided in four regions by means of standard head speed and optimal backspin.

Specifically, as shown in FIG. 5, a graph representing the relation between backspin (vertical axis) and head speed (HS, horizontal axis) is divided in four regions A to D by means of standard head speed and optimal backspin farther, the following spin-type ball classification table and distance-type ball classification table are prepared in advance. The spin-type ball classification table is used for selecting spin-type balls suitable for golfers which fall in regions A to D, respectively, in relation to head speed and optimal backspin. The distance-type ball classification table is used for selecting distance-type balls suitable for golfers which fall in regions A to D, respectively, in relation to head speed and optimal backspin. The control unit 16 automatically selects a distance-type ball or spin-type ball suitable for the golfer with reference to these tables.

Spin-type ball classification table:

Region A:

High HS, intermediate-spin-type golf balls a, b (two types)

Region B:

High HS, high-spin-type golf balls c, d (two types)

Region C:

Low HS, intermediate-spin-type golf balls e, f (two types)

Region D:

Low HS, high-spin-type golf balls g, h (two types)

Distance-type ball classification table:

Region A:

High HS, low-spin-type golf balls i, j (two types)

Region B:

High HS, intermediate-spin-type golf balls k, l (two types)

Region C:

Low HS, low-spin-type golf balls m, n (two types)

Region D:

Low HS, intermediate-spin-type golf balls o, p (two types)

For example, for a golfer GA whose head speed and backspin fall within region A and for whom a spin-type ball is suitable, in order to decrease the backspin to a level closer to the optimal backspin, high-head-speed, intermediate-spin-type golf balls a and b are selected in accordance with the spin-type ball classification table. For a golfer GB whose head speed and backspin fall within region D and for whom a distance-type ball is suitable, in order to increase the backspin to a level closer to the optimal backspin, low-head-speed, intermediate-spin-type golf balls o and p are selected in accordance with the distance-type ball classification table.

(7) Subsequently, the comment producing means produces a comment on the golf club that the golfer used first. The comment is produced on the basis of the head speed, backspin, and side spin obtained in (1) above. Further, a comment on the golf club that the golfer has selected is produced on the basis of the backspin, side spin, and travel distance obtained in (4) above. Specifically, a sentence is prepared for a certain range of each value as described below and stored in the control unit 16. When a value falls within the corresponding range, the corresponding sentence is selected. These sentences for the respective values are connected automatically so as to produce a comment.

The head speed obtained in (1) falls within a predetermined range: "HEAD SPEED IS SLIGHTLY EXCESSIVE, AND SR, S, OR SIMILAR FLEX IS PROPER."

The backspin obtained in (1) is slightly greater than ideal backspin: "BACKSPIN IS SLIGHTLY EXCESSIVE."

The side spin obtained in (1) is close to ideal side spin: "TRAJECTORY IS SUBSTANTIALLY STRAIGHT."

These sentences are connected so as to obtain a comment "HEAD SPEED IS SLIGHTLY EXCESSIVE, AND SR, S FLEX, OR SIMILAR TYPE IS SUITABLE. BACKSPIN IS SLIGHTLY EXCESSIVE, BUT TRAJECTORY IS SUBSTANTIALLY STRAIGHT" as a comment on the golf club that the golfer used first.

The backspin obtained in (4) has decreased from the backspin obtained in (1) by a predetermined amount and approaches ideal backspin: "BACKSPIN DECREASES TO A LEVEL CLOSER TO THE PROPER LEVEL."

The side spin obtained in (4) is substantially equal to the backspin obtained in (1) and is close to the ideal side spin: No comment.

The travel distance obtained in (4) has increased considerably as compared to that obtained in (1): "TRAVEL DISTANCE HAS BEEN EXTENDED GREATLY."

These sentences are connected so as to obtain a comment "BACKSPIN DECREASES TO A LEVEL CLOSER TO THE PROPER LEVEL. SIDE SPIN HAS NOT CHANGED, BUT TRAVEL DISTANCE HAS BEEN EXTENDED GREATLY." as a comment on the golf club that the golfer has selected.

Figure 6:
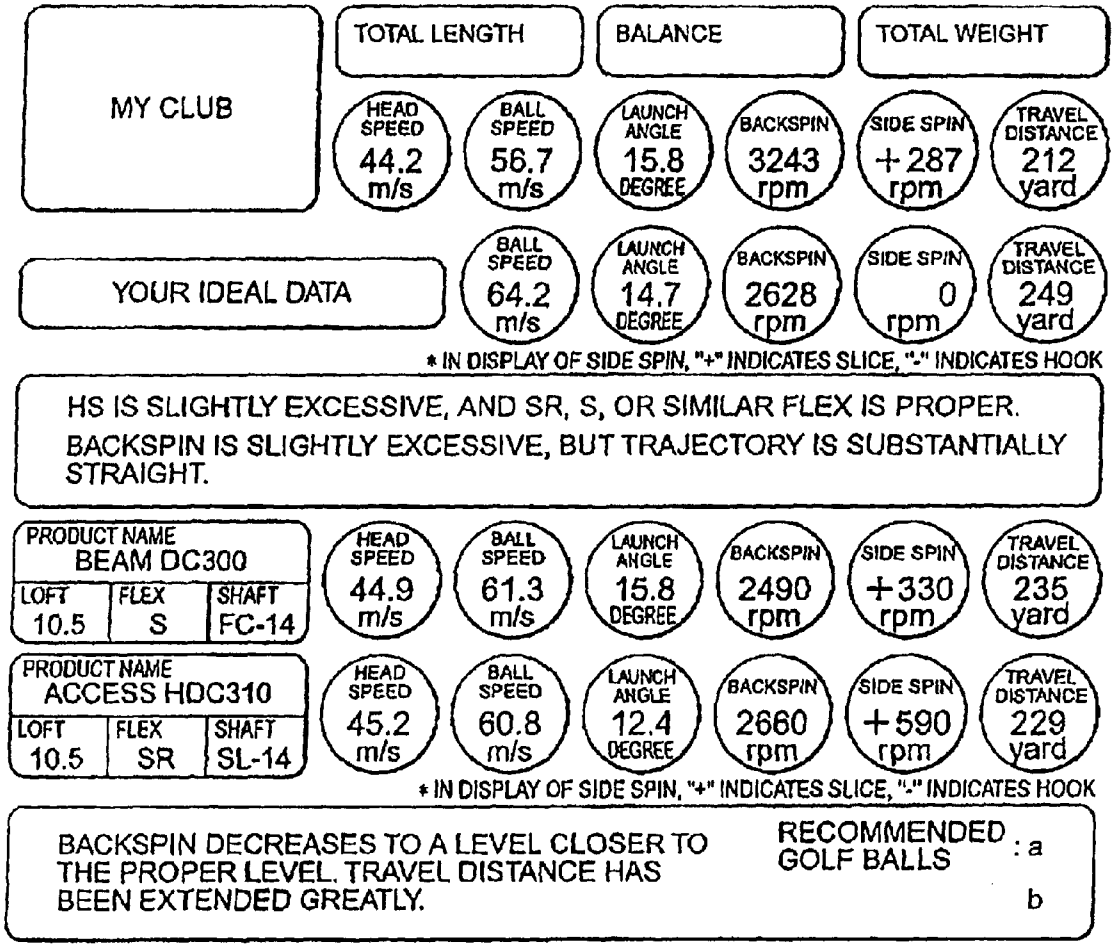
FIG. 6 is a diagram of an example sheet produced by the printing means of the system of FIG. 1.

(8) The printer 18 prints, on a predetermined sheet, the head speed, initial speed, launch angle, backspin, side spin, and travel distance obtained in (1) above; the ideal initial speed, launch angle, backspin, side spin, and travel distance obtained in (2) above, the name of the golf club selected in (3) above; the head speed, initial speed, launch angle, backspin, side spin, and travel distance of the selected golf club obtained in (4) above; and the name of the golf ball selected in (6) above. FIG. 6 shows an example sheet produced by the printing means. In FIG. 6, the term "MY CLUB" means the golf club with which the golfer hit golf balls in (1) above; and the term "BALL SPEED" means initial speed.

What is claimed is:

1. A method for selecting a golf club and golf ball suitable for a golfer, comprising the steps of:

(a) obtaining at least one of head speed and hit-ball data when a golfer hits a golf ball with a golf club;

(b) obtaining ideal hit-ball data of the golfer on the basis of the at least one of head speed and hit-ball data obtained in step (a);

(c) selecting a golf club suitable for the golfer on the basis of the ideal hit-ball data obtained in step (b);

(d) obtaining at least one of head speed and hit-ball data when the golfer hits a golf ball with the golf club selected in step (c);

(e) obtaining, from the golfer, ball-type selection data for determining which among a plurality of ball types is suitable for the golfer; and (f) selecting a golf ball of a type suitable for the golfer, on the basis of the at least one of head speed and hit-ball data obtained in step (d) and the ball-type selection data obtained in step (d).

2. A method for selecting a golf ball according to claim 1, wherein in step (a), when the golfer hits a golf ball with a golf club, head speed and backspin of the hit golf ball are obtained; and in step (f), a golf ball of a type suitable for the golfer is selected on the basis of the head speed and the backspin of the hit-ball obtained in step (a) and the ball-type selection data obtained in step (e), in such a manner that the selected golf ball produces backspin close to optimal backspin corresponding to the head speed.

3. A method for selecting a golf ball according to claim 1, wherein in step (a), ball-type selection data for determining whether a distance-type ball or a spin-type ball is suitable for the golfer are obtained from the golfer; and in step (f), a distance-type golf ball or spin-type golf ball suitable for the golfer is selected on the basis of the at least one of head speed and hit-ball data, or the head speed and backspin of the hit ball, obtained in step (a) and the ball-type selection data obtained in step (e).

4. A method for selecting a golf ball according to claim 1, wherein in step (e), at least one set of data selected from an average round score of the golfer, a handicap of the golfer, and a performance of the golf ball which the golfer requires are obtained from the golfer as ball-type selection data.

5. A method for selecting a golf ball according to claim 1, wherein in step (d), when the golfer hits a golf ball with the golf club selected in step (c), head speed and backspin of the hit golf ball are obtained; and in step (f), a golf ball of a type suitable for the golfer is selected on the basis of the head speed and the backspin of the hit-ball obtained in step (d) and the ball-type selection data obtained in step (e), in such a manner that the selected golf ball produces backspin close to optimal backspin corresponding to the head speed.

6. A method for selecting a golf ball according to claim 1, wherein in step (e), ball-type selection data for determining whether a distance-type ball or a spin-type ball is suitable for the golfer are obtained from the golfer; and in step (f), a distance-type golf ball or spin-type golf ball suitable for the golfer is selected on the basis of the at least one of head speed and hit-ball data, or the head speed and backspin of the hit ball, obtained in step (d) and the ball-type selection data obtained in step (e).

7. A method for selecting a golf ball according to claim 1, wherein in step (e), at least one set of data selected from an average round score of the golfer, a handicap of the golfer, and a performance of the golf ball which the golfer requires are obtained from the golfer as ball-type selection data.

8. A system for selecting a golf club and golf ball suitable for a golfer, comprising:

actual hit data obtainment means for obtaining at least one of head speed and hit-ball data when a golfer hits a golf ball with a golf club; and ideal data obtainment means for obtaining ideal hit-ball data of the golfer on the basis of the at least one of head speed and hit-ball data obtained by the actual hit data obtainment means;

golf club selection means for selecting a golf club suitable for the golfer on the basis of the ideal hit-ball data obtained by the ideal data obtainment means;

means for obtaining at least one of head speed and hit-ball data when the golfer hits a golf ball with a golf club selected by said golf club selection means; and golf ball selecting means for selecting a golf ball of a type suitable for the golfer on the basis of the at least one of head speed and hit-ball data, which are obtained by the actual hit data obtainment means as actual hit data when the golfer hits a golf ball by use of the selected golf club, and the ball-type selection data obtained from the golfer and adapted for determining which among a plurality of ball types is suitable for the golfer.

9. A system according to claim 8, further comprising comment producing means for producing a comment for the golfer on the basis of the at least one of the head speed and hit-ball data obtained by the actual hit data obtainment means.

10. A system according to claim 9, further comprising printing means for printing at least one selected from the head speed and hit-ball data obtained by the actual hit data obtainment means, ideal hit-ball data obtained by the ideal data obtainment means, the name of the selected golf club, the name of the selected golf ball, and the comment produced by the comment producing means.

* * * * *